US012716171B2

(12) United States Patent
Petri et al.

(10) Patent No.: US 12,716,171 B2
(45) Date of Patent: Aug. 25, 2026

(54) MULTI-LAYER WOVEN FABRIC

(71) Applicant: Milliken & Company, Spartanburg, SC (US)

(72) Inventors: Patrick Petri, Greer, SC (US); John A. Sollars, Jr., LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 9 days.

(21) Appl. No.: 18/945,621

(22) Filed: Nov. 13, 2024

(65) Prior Publication Data

US 2025/0163640 A1 May 22, 2025

Related U.S. Application Data

(60) Provisional application No. 63/601,521, filed on Nov. 21, 2023.

(51) Int. Cl.
*D03D 11/00* (2006.01)
*A47C 27/00* (2006.01)
(Continued)

(52) U.S. Cl.
CPC ..... *D06N 3/0006* (2013.01); *A47C 27/002* (2013.01); *A47C 27/081* (2013.01);
(Continued)

(58) Field of Classification Search
CPC .. D06N 3/0006; D06N 3/14; D06N 2209/125; D06N 2211/00; A47C 27/002;
(Continued)

(56) References Cited

U.S. PATENT DOCUMENTS 3,575,776 A 4/1971 Macintyre
3,670,504 A * 6/1972 Hayes ..... D03D 11/02 405/32
(Continued)

FOREIGN PATENT DOCUMENTS

DE 8004709 U1 5/1980
DE 102021129762 A1 5/2023
(Continued)

OTHER PUBLICATIONS

Corrected International Search Report and Written Opinion issued in App. No. PCT/US2024/016707, dated Jul. 8, 2024, 7 pages.
(Continued)

*Primary Examiner* — Aaron R Eastman
(74) *Attorney, Agent, or Firm* — Cheryl J. Brickey

(57) ABSTRACT

The invention relates to a multi-layer woven fabric having a central region which contains a first woven layer, a second woven layer, and a plurality of connecting yarns. The plurality of connecting yarns connect the first woven layer and the second woven layer and each connecting yarn has a stitching pattern that contains a first weave section, a crossover section, and a second weave section. Within the first weave section, each connecting yarn is interwoven only with the first warp. Within the crossover section each connecting yarn is not interwoven with any yarns of the multi-layer woven fabric. Within the second weave section, each connecting yarn is interwoven only with the second warp yarns of the second woven layer.

27 Claims, 3 Drawing Sheets

(51) Int. Cl.
*A47C 27/08* (2006.01)
*D06N 3/00* (2006.01)
*D06N 3/14* (2006.01)

(52) U.S. Cl.
CPC ..... *D03D 11/00* (2013.01); *D06N 3/14* (2013.01); *D06N 2209/125* (2013.01); *D06N 2211/00* (2013.01); *D10B 2403/021* (2013.01)

(58) Field of Classification Search
CPC .... A47C 27/081; A47C 27/087; D03D 11/00; D03D 1/02; D03D 11/02; D03D 13/004; D10B 2403/021; D10B 2403/0331; D10B 2505/08
See application file for complete search history.

(56) References Cited

U.S. PATENT DOCUMENTS

| | | | | |
|---|---|---|---|---|
| 4,312,913 | A | 1/1982 | Rheaume | |
| 5,651,395 | A * | 7/1997 | Graham | D03D 1/02 139/390 |
| 5,682,771 | A * | 11/1997 | Forest | D04B 1/22 66/198 |
| 6,010,652 | A | 1/2000 | Yoshida | |
| 7,353,669 | B2 | 4/2008 | Ternon | |
| 7,549,669 | B2 | 6/2009 | Keshavaraj | |
| 7,736,701 | B2 | 6/2010 | Keshavaraj | |
| 8,007,630 | B1 | 8/2011 | Keshavaraj | |
| 8,118,324 | B2 | 2/2012 | Sollars, Jr. | |
| 9,447,528 | B1 * | 9/2016 | Sturgeon | D03D 1/0041 |
| 10,301,505 | B2 | 5/2019 | Keshavaraj | |
| 10,799,031 | B2 | 10/2020 | Alder | |
| 11,007,969 | B2 * | 5/2021 | Albiez | D03D 11/02 |
| 11,203,828 | B2 | 12/2021 | Keshavaraj | |
| 11,470,982 | B2 | 10/2022 | Johannessen | |
| 11,528,998 | B2 | 12/2022 | Miller, Jr. | |
| 2005/0121891 | A1 | 6/2005 | Sollars, Jr. | |
| 2008/0026657 | A1 | 1/2008 | Sollars | |
| 2011/0061842 | A1 * | 3/2011 | Li | D04B 1/14 442/318 |
| 2014/0021705 | A1 | 1/2014 | Youn | |
| 2016/0166077 | A1 | 6/2016 | Liu | |
| 2017/0342655 | A1 | 11/2017 | Keshavaraj | |
| 2018/0119320 | A1 * | 5/2018 | Candrian-Bell | A47C 27/081 |
| 2019/0195427 | A1 | 6/2019 | Alexander | |
| 2020/0180545 | A1 | 6/2020 | Keshavaraj | |
| 2024/0148107 | A1 | 5/2024 | Coakley | |
| 2024/0216201 | A1 | 7/2024 | Fox | |
| 2024/0217186 | A1 | 7/2024 | Xia | |
| 2025/0319837 | A1 * | 10/2025 | Thorpe | B60R 21/235 |

FOREIGN PATENT DOCUMENTS

| | | | |
|---|---|---|---|
| EP | 1237766 | B1 | 9/2005 |
| FR | 2063535 | A5 | 7/1971 |

OTHER PUBLICATIONS

International Search Report and Written Opinion issued in App. No. PCT/US2024/016707, dated May 31, 2024, 14 pages.
PCT Communication in Cases for Which No Other Form is Applicable issued in App. No. PCT/US2024/016707, dated Jul. 8, 2024, 6 pages.
International Search Report and Written Opinion issued in App. No. PCT/US2024/055655, dated Feb. 10, 2025, 16 pages.

* cited by examiner

MULTI-LAYER WOVEN FABRIC

RELATED APPLICATIONS

This application claims priority to U.S. Provisional Patent Application 63/601,521 filed on Nov. 21, 2023, which is hereby incorporated by reference in its entirety.

TECHNICAL FIELD OF THE INVENTION

The present invention is directed towards inflatable support articles, more particularly, multi-layer woven inflatable support articles for mattresses and cushions.

BACKGROUND

Inflatable air mattresses and cushions are typically manufactured by bonding, sealing, or welding layers of impermeable material that can include polymer sheets or textile reinforced material incorporating an impermeable membrane, film, or coating. This material is then formed into an inflatable structure with internal connections added to control the inflated shape. These prior art methods of making inflatable support articles tend to be complex, expensive and time consuming to make, typically use environmentally unfriendly materials, and are prone to have limitations in strength that can lead to mechanical failure or leakage. It would be desirable to have an inflatable structure that has a simpler construction, a better manufacturing process, and less environmental impact.

BRIEF SUMMARY OF THE INVENTION

The invention relates to a multi-layer woven fabric having a first side and a second side and having a warp and weft direction, where the weft direction is perpendicular to the warp direction. The multi-layer woven fabric contains a central region and at least one outer region, where the central region has a starting edge area and an ending edge area in the weft direction of the multi-layer woven fabric.

The central region contains a first woven layer, a second woven layer, and a plurality of connecting yarns. The first woven layer has upper and lower surfaces and contains a plurality of first warp yarns and first weft yarns. The upper surface of the first woven layer forms the first side of the multi-layer woven fabric. The second woven layer has upper and lower surfaces and contains a plurality of second warp yarns and second weft yarns. The lower surface of the second woven layer forms the second side of the multi-layer woven fabric.

The plurality of connecting yarns connect the first woven layer and the second woven layer. Each connecting yarn has a stitching pattern that contains a first weave section, a crossover section, and a second weave section. Within the first weave section, each connecting yarn is interwoven only with the first warp yarns of the first woven layer and the first weave section begins at the starting edge area of the central region and ends at a final weave stitch with the first warp yarns of the first woven layer. Within the crossover section each connecting yarn is not interwoven with any yarns of the multi-layer woven fabric. The crossover section begins at the final weave stitch with the first warp yarns of the first woven layer and ends with a first weave stitch with the second warp yarns of the second woven layer. The length of connecting yarn between the final weave stitch with the first warp yarns and the first weave stitch with the second warp yarns of the second woven layer is defined as the crossover distance. Within the second weave section, each connecting yarn is interwoven only with the second warp yarns of the second woven layer and the second weave section begins at the first weave stitch with the second warp yarns of the second woven layer and ends at the ending edge area of the central region.

Within the starting edge area of the central region essentially all of the connecting yarns are not interwoven with the second woven layer and at least a portion of the connecting yarns are interwoven with the first woven layer. Within the ending edge area of the central region essentially all of the connecting yarns are not interwoven with the first woven layer and at least a portion of the connecting yarns are interwoven with the second woven layer.

In another embodiment, the invention relates to an air impermeable multi-layer woven fabric having a first side and a second side and having a warp and weft direction, where the weft direction is perpendicular to the warp direction. The multi-layer woven fabric contains a central region and at least one outer region, where the central region has a starting edge area and an ending edge area in the weft direction of the multi-layer woven fabric.

The central region contains a first woven layer, a second woven layer, and a plurality of connecting yarns. The first woven layer has upper and lower surfaces and contains a plurality of first warp yarns and first weft yarns. The upper surface of the first woven layer forms the first side of the multi-layer woven fabric. The second woven layer has upper and lower surfaces and contains a plurality of second warp yarns and second weft yarns. The lower surface of the second woven layer forms the second side of the multi-layer woven fabric.

The plurality of connecting yarns connect the first woven layer and the second woven layer. Each connecting yarn has a stitching pattern that contains a first weave section, a crossover section, and a second weave section. Within the first weave section, each connecting yarn is interwoven only with the first warp yarns of the first woven layer and the first weave section begins at the starting edge area of the central region and ends at a final weave stitch with the first warp yarns of the first woven layer. Within the crossover section each connecting yarn is not interwoven with any yarns of the multi-layer woven fabric. The crossover section begins at the final weave stitch with the first warp yarns of the first woven layer and ends with a first weave stitch with the second warp yarns of the second woven layer. The length of connecting yarn between the final weave stitch with the first warp yarns and the first weave stitch with the second warp yarns of the second woven layer is defined as the crossover distance. Within the second weave section, each connecting yarn is interwoven only with the second warp yarns of the second woven layer and the second weave section begins at the first weave stitch with the second warp yarns of the second woven layer and ends at the ending edge area of the central region.

Within the starting edge area of the central region essentially all of the connecting yarns are not interwoven with the second woven layer and at least a portion of the connecting yarns are interwoven with the first woven layer. Within the ending edge area of the central region essentially all of the connecting yarns are not interwoven with the first woven layer and at least a portion of the connecting yarns are interwoven with the second woven layer.

The air impermeable multi-layer woven fabric also contains an air impermeable layer located on the first side and the second side of the multi-layer woven fabric.

In another embodiment, the invention relates to an inflatable support article. The inflatable support article contains an air impermeable multi-layer woven fabric, where the air impermeable multi-layer woven fabric is configured to form a three-dimensional enclosed space having an outer surface and an inner surface, and a port through the air impermeable multi-layer woven fabric.

The air impermeable multi-layer woven fabric has a first side and a second side and having a warp and weft direction, where the weft direction is perpendicular to the warp direction. The multi-layer woven fabric contains a central region and at least one outer region, where the central region has a starting edge area and an ending edge area in the weft direction of the multi-layer woven fabric.

The central region contains a first woven layer, a second woven layer, and a plurality of connecting yarns. The first woven layer has upper and lower surfaces and contains a plurality of first warp yarns and first weft yarns. The upper surface of the first woven layer forms the first side of the multi-layer woven fabric. The second woven layer has upper and lower surfaces and contains a plurality of second warp yarns and second weft yarns. The lower surface of the second woven layer forms the second side of the multi-layer woven fabric.

The plurality of connecting yarns connect the first woven layer and the second woven layer. Each connecting yarn has a stitching pattern that contains a first weave section, a crossover section, and a second weave section. Within the first weave section, each connecting yarn is interwoven only with the first warp yarns of the first woven layer and the first weave section begins at the starting edge area of the central region and ends at a final weave stitch with the first warp yarns of the first woven layer. Within the crossover section each connecting yarn is not interwoven with any yarns of the multi-layer woven fabric. The crossover section begins at the final weave stitch with the first warp yarns of the first woven layer and ends with a first weave stitch with the second warp yarns of the second woven layer. The length of connecting yarn between the final weave stitch with the first warp yarns and the first weave stitch with the second warp yarns of the second woven layer is defined as the crossover distance. Within the second weave section, each connecting yarn is interwoven only with the second warp yarns of the second woven layer and the second weave section begins at the first weave stitch with the second warp yarns of the second woven layer and ends at the ending edge area of the central region.

Within the starting edge area of the central region essentially all of the connecting yarns are not interwoven with the second woven layer and at least a portion of the connecting yarns are interwoven with the first woven layer. Within the ending edge area of the central region essentially all of the connecting yarns are not interwoven with the first woven layer and at least a portion of the connecting yarns are interwoven with the second woven layer.

The air impermeable multi-layer woven fabric also contains an air impermeable layer located on the first side and the second side of the multi-layer woven fabric.

DETAILED DESCRIPTION

Figure 1:
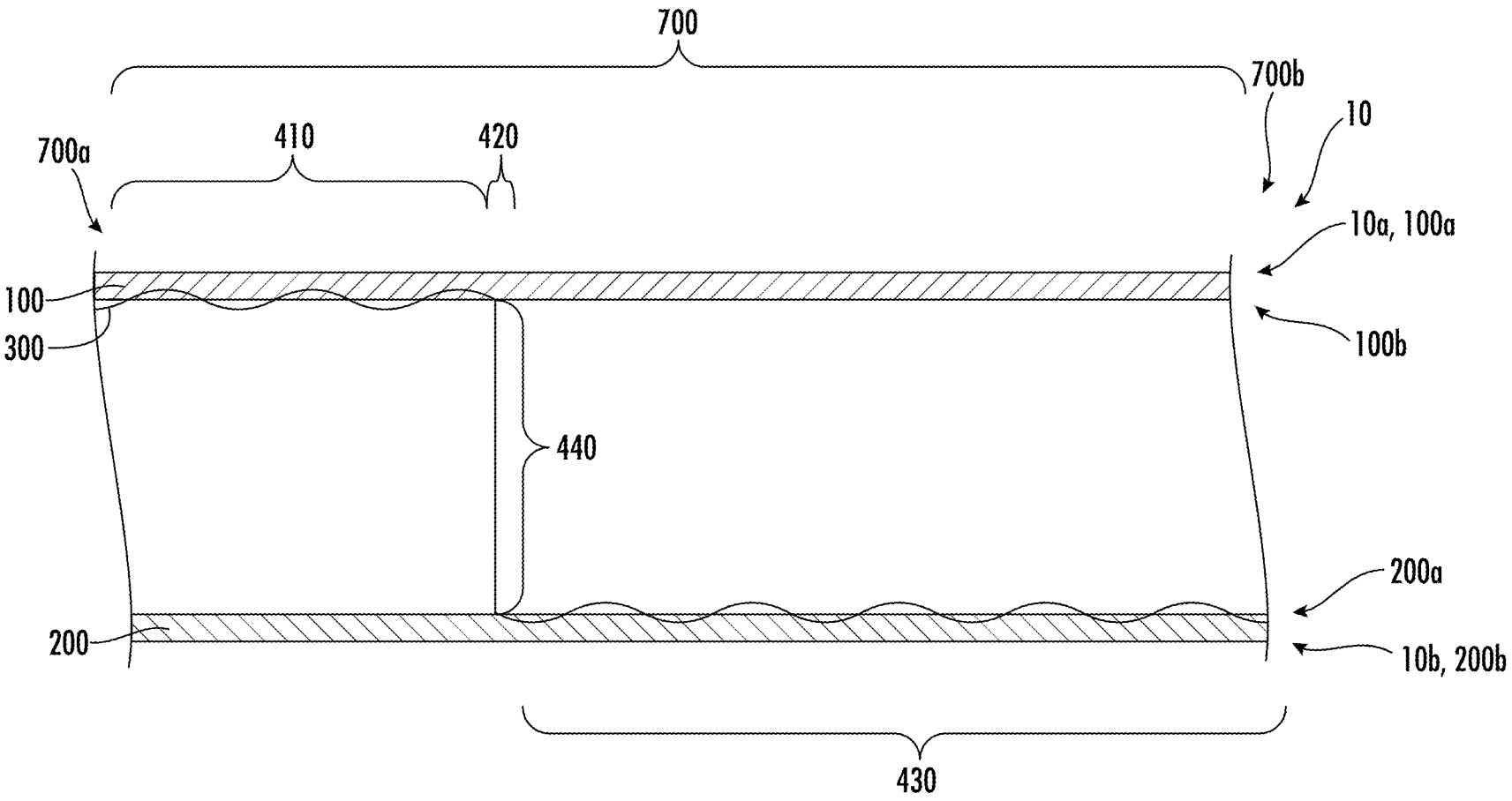
FIG. 1 is an illustration of a cross-section of one embodiment of the multi-layer woven of the invention showing one connecting yarn.

The multi-layer woven fabric 10 as shown in FIG. 1, has a first side 10*a* and a second side 10*b* and has a warp direction and a weft direction and is showing a portion of the central region of the multi-layer woven fabric. The weft direction is parallel to the plane of the paper (i.e., the lines shown going from left to right on the paper are in the weft direction). The warp direction is perpendicular to the weft direction and would be into the plane of the paper (the warp yarns are not shown in FIG. 1 but would be coming out of the paper towards the viewer). While the warp direction is defined as being perpendicular to the weft direction, in the actual fabric, the two directions are approximately perpendicular to each other due to the manufacturing process and inherent movement of yarns within a fabric.

The multi-layer woven fabric 10 contains a central region 700 and at least one outer region 710 such as shown in FIG. 5. In FIG. 5, there is shown an embodiment having two outer regions 710, where one of the outer regions 710 runs parallel to the starting edge area 700*a* of the central region and one of the outer regions 710 runs parallel to the ending edge area 700*b* of the central region. These outer regions 710 run along the warp direction of the multi-layer woven fabric 10. Note that the starting edge area 700*a* is an area, not a single line or point. It is the area where the main stitching features of the central region begin. Note that the ending edge area 700*b* is an area, not a single line or point. It is the area where the main stitching features of the central region end.

The central region of the multi-layer woven fabric (such as shown in FIG. 1) contains a first woven layer 100. The first woven layer 100 has an upper surface 100*a* and a lower surface 100*b* and contains a plurality of first warp yarns and first weft yarns. The upper surface 100*a* of the first woven layer 100 forms the first side 10*a* of the multi-layer woven fabric 10.

The central region of the multi-layer woven fabric (such as shown in FIG. 1) also contains a second woven layer 200. The second woven layer 200 has an upper surface 200*a* and a lower surface 200*b* and contains a plurality of second warp yarns and second weft yarns. The lower surface 200*b* of the second woven layer 100 forms the second side 10*b* of the multi-layer woven fabric 10.

The first woven layer 100 and second woven layer 200 each contain warp yarns interwoven with weft yarns. In one embodiment, the first warp yarns and the first weft yarns of the first woven layer are in a plain weave, though other weaves may be utilized. In one embodiment, the second warp yarns and the second weft yarns of the second woven layer are in a plain weave, though other weaves may be utilized.

The central region of the multi-layer woven fabric 10 also contains a plurality of connecting yarns. These yarns connect the first woven layer 100 and the second woven layer 200 and they preferably run in the weft direction of the fabric 10. In FIG. 1, there is shown a single connecting yarn so that the different sections and stitching of the connecting yarns can be more clearly seen. Each connecting yarn has a stitching pattern that contains a first weave section 410, a crossover section 420, and a second weave section 430.

In the first weave section for each connecting yarn, the connecting yarn is only interwoven only with the first warp yarns of the first woven layer 100. This can include both interwoven and float (or skipped) stitches. The connecting yarn preferably contains a plurality of stitches and floats with the first warp yarns in the first woven section, but in some embodiments may float for the majority of the width of the section 410. The first weave section 410 begins at the starting edge area 700*a* of the central region 700 and ends at a final weave stitch with the first warp yarns of the first woven layer.

The next section for the connecting yarn is the crossover section 420 where the connecting yarn 300 travels from the first woven layer 100 to the second woven layer 200. In this crossover section 420, each connecting yarn is not interwoven with any yarns of the multi-layer woven fabric (including the yarns from the first woven layer, yarns from the second woven layer, and other connecting yarns). The crossover section begins at the final weave stitch with the first warp yarns of the first woven layer and ends with a first weave stitch with the second warp yarns of the second woven layer. Therefore, the width of the connecting section 420 along the weft direction of the central section is small compared to the first weave section and the second weave section. The length of connecting yarn between the final weave stitch with the first warp yarns and the first weave stitch with the second warp yarns of the second woven layer is defined as the crossover distance 440. This crossover distance is what sets the thickness of the multi-layer woven fabric 10 when it is inflated. In one embodiment, the crossover distance is between about 0.1 and 25 inches, more preferably and 0.25 and 15 inches, more preferably between about 0.45 and 10 inches. In another embodiment, the crossover distance is greater than about 1 inch, more preferably greater than about 2 inches. In another embodiment, the crossover distance is less than about 30 inches, more preferably less than about 20 inches, more preferably less than about 8 inches. In one preferred embodiment, the crossover distance is between about 2 and 8 inches. In another preferred embodiment, the crossover distance is between about 4 and 8 inches. It has been found that these ranges are able to produce multi-layer fabrics 10 for use in mattresses and other inflatable articles that provide good support to the person or thing.

In one embodiment, the crossover distances 440 are essentially the same for every connecting yarn, defined as being within 10% of the average length of the crossover distances. This is preferred as it ensures a consistent inflation amount that may be preferable for some support articles. In another embodiment, at least a portion of the crossover distances 440 vary. This may be individually or in grouped areas, for example, a mattress may be preferably made with a larger crossover distance in a pillow area of a mattress and smaller crossover distances for the remainder of the central region. In another example, the surface of the mattress may be contoured to the shape of a human, providing optimal lumbar support.

Figure 2:
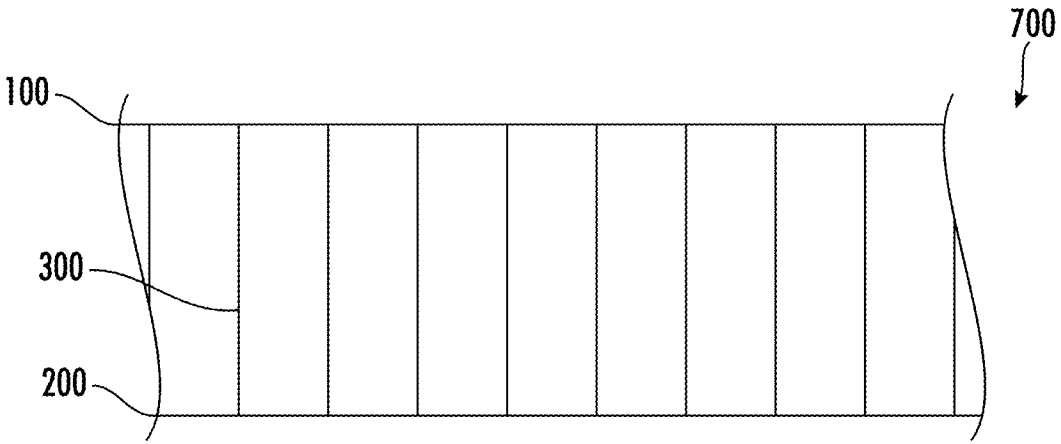
FIG. 2 is a cross-section of one embodiment of the multi-layer woven fabric of the invention.

Preferably, at least two connecting yarns have different first weave section widths, more preferably at least 6 connecting yarns, more preferably at least 16 connecting yarns have different first weave section widths. The connecting yarns 300 start by being interwoven with the first woven layer 100 in the first weave section 410 and vary in the amount of distance in the weft direction before leaving the first woven layer and traveling to the second woven layer. This arrangement of connecting yarns 300 is shown in the simplified FIG. 2 which show the connecting yarns crossing between the first and second woven layers at different points in the weft direction of the central region 700. In one preferred embodiment, looking at the cross-section of the central region 700 such as illustrated in FIG. 2, there is a connecting yarn in the connecting region (traveling between the first and second woven layers) each about 0.5 to 4 inches, more preferably about 0.7 and 1.3 inches. This difference in first weave widths causes a difference in the second weave widths. Preferably, at least two connecting yarns have different second weave section widths, more preferably at least 6 connecting yarns, more preferably at least 16 connecting yarns have different second weave section widths.

After the connecting section, the connecting yarns are in the second weave section 430 where each connecting yarn is interwoven only with the second warp yarns of the second woven layer. This can include both interwoven and float (or skipped) stitches. The connecting yarn preferably contains a plurality of stitches and floats with the second warp yarns in the second woven section, but in some embodiments may float for the majority of the width of the section 430. The second weave section 430 begins at the first weave stitch with the second warp yarns of the second woven layer and ends at the ending edge area 700*b* of the central region 700.

In one embedment, within the starting edge area 700*a* of the central region 700 essentially all of the connecting yarns 300 are interwoven with the first woven layer 100 and within the ending edge area 700*b* of the central region 700 essentially all of the connecting yarns 300 are interwoven with the second woven layer 430.

In another embodiment, within the starting edge area of the central region essentially all of the connecting yarns are not interwoven with the second woven layer and at least a portion of the connecting yarns are interwoven with the first woven layer. Within the ending edge area of the central region essentially all of the connecting yarns are not interwoven with the first woven layer and at least a portion of the connecting yarns are interwoven with the second woven layer.

In the central section of the multi-layer woven fabric, there are between about 2 and 20 weft yarns for every connecting yarn, preferably about 4 weft yarns for every connecting yarn. Too few connecting yarns limit the inflation pressure of the article, and too many skipped weft yarns result in a loose or weak fabric surface.

Each of the yarns of the fabric (first warp yarns, first weft yarns, second warp yarns, second weft yarns, connecting yarns) may be formed of (but are not limited to) cellulosic yarns (such as cotton, rayon, linen, jute, hemp, cellulose acetate, and combinations, mixtures, or blends thereof), polyester yarns (e.g., poly(ethylene terephthalate) yarns, poly(propylene terephthalate) (PET) yarns, poly (trimethylene terephthalate) yarns), poly(butylene terephthalate) yarns, and blends thereof), polyamide yarns (e.g., nylon 6 yarns, nylon 6,6 yarns, nylon 4,6 yarns, and nylon 12 yarns), polyvinyl alcohol yarns, an elastic polyester-polyurethane copolymer (SPANDEX®), polypropylene yarns, polyethylene yards, polyvinyl acetate yarns, polylactic acid yarns, flame-resistant meta-aramid (NOMEX®) or para-aramid, and combinations, mixtures, or blends thereof.

In one embodiment, wherein the first warp yarns and second warp yarns are the same type of yarn. In another embodiment, the first weft yarns and second weft yarns are the same type of yarn.

In one preferred embodiment, the multi-layer woven fabric 10 contains at least 90% by number of multifilament polyester yarns as these have been shown to have good performance at low cost. In another embodiment, the central section of the multi-layer woven fabric 10 contains at least 90% by number of multifilament polyester yarns. In another embodiment, the woven fabric contains nylon yarns. In another embodiment, there may be more than one type of yarn within a woven layer (varying in materials, construction, and/or denier) or the yarns used may contain more than one type of fiber. In one embodiment, the connecting yarns have a tensile strength of at least 3 pounds of force. Having a good tensile strength to the connecting yarns is important to prevent breakage of the yarns during inflation and use.

Figure 3A:
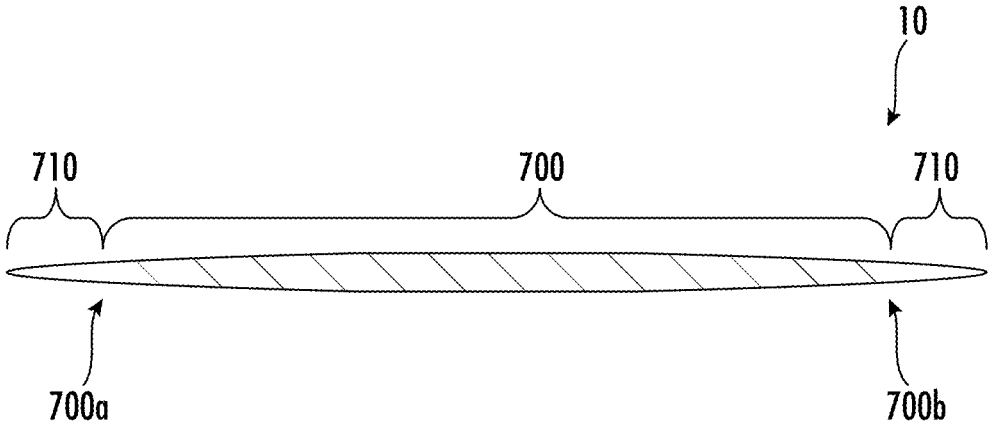
FIGS. 3A and 3B are illustrations of a cross-section of one embodiment of the multi-layer woven fabric being not inflated (FIG. 3A) and being inflated (FIG. 3B).
Figure 3B:
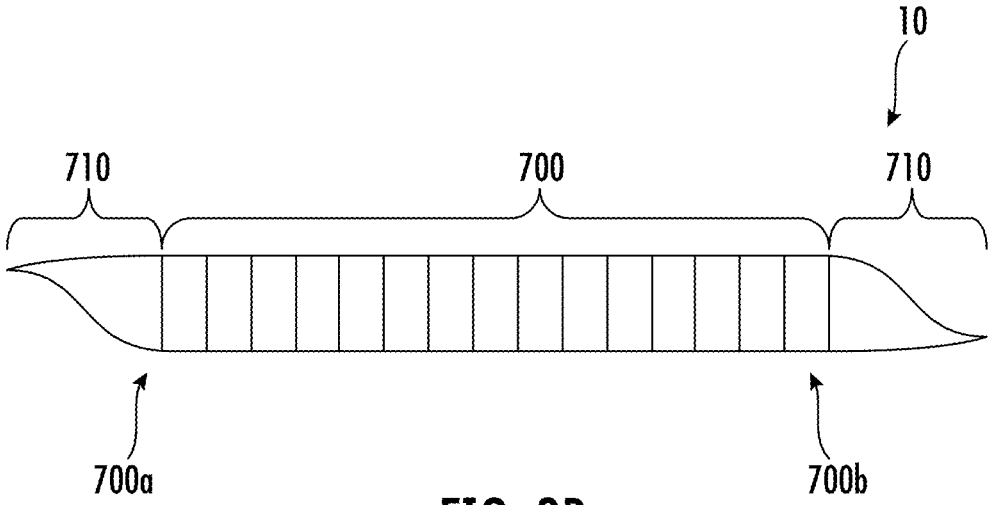

Referring to FIGS. 3A and 3B, there is shown an embodiment of the multi-layer woven fabric 10 having a central section 700 and two outer regions 710, where the outer regions run along the sides of the central region 700 in the warp direction of the fabric 10. In other embodiments, there may be a single outer region 710 on just one side or a single outer region that extends around the entire perimeter of the central section 700. In other embodiments, there are 3 or 4 or more outer sections in the fabric 10. FIG. 3A is rotated 180 degrees from the orientation shown in FIG. 1 (which is why the connecting yarns are shown in a/slant instead of a \ slant as they would be in FIG. 1).

FIG. 3A shows how the fabric 10 looks after it is woven with the first woven layer 100 and the second woven layer 200 very close together and the connecting yarns crossing between the two layers at a diagonal. FIG. 3B shows how the fabric looks when air is introduced into the fabric 10. The first and second woven layer 100, 200 are further apart, constrained by the connecting yarns that connect the two layers. The distance between the first woven layer 100 and the second woven layer 200 is approximately the crossover distance of the connecting yarns. Once inflated, the connecting yarns are more perpendicular to the woven layers 100, 200.

In the at least one outer region, the first woven layer 100 and the second woven layer 200 are attached. The attachment may be made using any suitable method. The attachment means includes, but is not limited to adhesives, use of low melt fibers and/or yarns, ultrasonic welding, stitching, interweaving of the woven layers, and combinations of these attachment means.

In one preferred method, the first and second woven layers 100, 200 are interwoven in at least a portion of the outer region. In this interwoven area, at least a portion of the first weft yarns is interwoven with the second warp yarns and at least a portion of the second weft yarns are interwoven with the first warp yarns.

In one embodiment, the multi-layer woven fabric has an air impermeable layer covering the majority of the first and second sides of the multi-layer woven fabric forming an air impermeable multi-layer woven fabric. Preferably, this air impermeable layer covers at least 80% of the surface area of the first and second woven layers. Preferably, this air impermeable layer covers almost the entire surface area of the woven fabric, more preferably covers at least 95% of the surface area of the woven fabric. In one embodiment, the air impermeable layer has a thickness of at least about 12 microns, more preferably at least about 50 microns. In another embodiment, the air impermeable layer has a thickness of between about 10 and 350 microns, more preferably between 12 about 250 microns, more preferably between 25 about 100 microns.

The air impermeable layer may contain any suitable materials. The materials may be, for example but not limited to, elastomeric polymer, rubber, nylon, urethane, silicone, polyvinyl chloride, and mixtures thereof. In one preferred embodiment, the air impermeable layer comprises a thermoplastic urethane. The air impermeable layer may also contain additional additives such as $TiO_2$, or other opacifying agents, antimicrobial, anti-fungal, UV absorbing, or dyes/pigments.

In some embodiments, a primer layer may be applied to the fabric 10 before the air impermeable layer is added to help with adhesion. This primer layer may be an adhesive layer being heat and/or pressure activated. The adhesive may be a low melt polymer.

The support article preferably holds an air pressure of 85% of an initial inflating pressure chosen in a range of between 4.1 and 8.3 kPa (0.6 and 1.2 PSI) for at least 24 hours.

The air impermeable layer may be applied to the woven fabric in any suitable manner such as coating, spraying, printing, gravure printing, dip coating, knife or blade coating, curtain coating, or lamination using either a liquid or solid adhesive that bonds using heat and/or pressure.

In another embodiment, the top and bottom surfaces are preferably coated or laminated with film, rubber, elastomer, or the like to make the surface airtight and capable of being inflated. In one embodiment, the film is a freestanding film. In another preferred embodiment, the air impermeable layer is extrusion coated onto the first side and the second side of the multi-layer woven fabric. In another preferred embodiment, the impermeable layer is a free-standing film.

The air impermeable multi-layer woven fabric may also include additional layers such as additional adhesive layers or additional fabric layers. These additional fabric layers may provide additional strength to the air impermeable multi-layer woven fabric or provide a more aesthetic surface.

The air impermeable multi-layer woven may be used to create an inflatable support article. The inflatable support article may be any suitable article where someone or something is supported. One of the largest end uses for these inflatable support articles are mattresses. Other articles include, but are not limited to, pet beds, couches, vehicle airbags, cushions (attached or separate from a seating structure), airplane seating, camping pads/mattresses, and pool floats. The air impermeable multi-layer woven fabric is configured to form a three-dimensional enclosed space having an outer surface and an inner surface and has a port through the air impermeable multi-layer woven fabric. Air (or other liquid or gas) is introduced through the port into the three-dimensional enclosed space to inflate the air impermeable multi-layer woven fabric which then supports the user. In some embodiments, the article contains an air source capable of introducing gas into the three-dimensional enclosed space.

In one embodiment, the multi-layer woven fabric 10 is made as a one-piece woven fabric, where the multi-layer fabric 10 is made with all of the layers being woven together simultaneously on the same loom. This would be a preferred way of making the woven fabric because the connections between the top and bottom surfaces and the shape defining internal layers are integral with each other and inherently stronger than if the connections are glued, welded, or otherwise bonded. The top and bottom surfaces along with the shape defining inner layers come from the loom already in their final shape, eliminating the need for time consuming assembly steps to subsequently fabricate and add the internal shape defining elements.

A multi-layer woven fabric was made according to the invention, had an air impermeable film attached to both sides, and was formed into a three-dimensional rectangular article (similar to a mattress shape). Air was introduced through a port and the support article was found to hold air and have good properties for an air mattress.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A multi-layer woven fabric having a first side and a second side and having a warp and weft direction, wherein the weft direction is perpendicular to the warp direction, and wherein the multi-layer woven fabric contains a central region and at least one outer region, wherein the central region has a starting edge area and an ending edge area in the weft direction of the multi-layer woven fabric, wherein the central region comprises:

a first woven layer having an upper and lower surfaces and comprising a plurality of first warp yarns and first weft yarns, wherein the upper surface of the first woven layer forms the first side of the multi-layer woven fabric;

a second woven layer having an upper and lower surfaces and comprising a plurality of second warp yarns and second weft yarns, wherein the lower surface of the second woven layer forms the second side of the multi-layer woven fabric; and, a plurality of connecting yarns, wherein the connecting yarns connect the first woven layer and the second woven layer, wherein each connecting yarn has a stitching pattern that consists of a first weave section, a crossover section, and a second weave section;

wherein within the first weave section each connecting yarn is interwoven only with the first warp yarns of the first woven layer and the first weave section begins at the starting edge area of the central region and ends at a final weave stitch with the first warp yarns of the first woven layer;

wherein within the crossover section each connecting yarn is not interwoven with any yarns of the multi-layer woven fabric, wherein the crossover section begins at the final weave stitch with the first warp yarns of the first woven layer and ends with a first weave stitch with the second warp yarns of the second woven layer, wherein the length of connecting yarn between the final weave stitch with the first warp yarns and the first weave stitch with the second warp yarns of the second woven layer is defined as the crossover distance;

wherein within the second weave section each connecting yarn is interwoven only with the second warp yarns of the second woven layer and the second weave section begins at the first weave stitch with the second warp yarns of the second woven layer and ends at the ending edge area of the central region; and wherein within the starting edge area of the central region all of the connecting yarns are not interwoven with the second woven layer and at least a portion of the connecting yarns are interwoven with the first woven layer, and wherein within the ending edge area of the central region all of the connecting yarns are not interwoven with the first woven layer and at least a portion of the connecting yarns are interwoven with the second woven layer.

2. The multi-layer woven fabric of claim 1, wherein the crossover distance is between about 4 and 8 inches.

3. The multi-layer woven fabric of claim 1, wherein crossover distances are within 10% of the average length of the crossover distances for every connecting yarn.

4. The multi-layer woven fabric of claim 1, wherein the distance between the starting edge area of the central region and the final weave stitch with the first warp yarns of the first woven layer is defined as the first weave section width and wherein at least two connecting yarns have different first weave section widths.

5. The multi-layer woven fabric of claim 1, wherein the distance between the first weave stitch with the second warp yarns of the second woven layer the ending edge area of the central region is defined as the second weave section width and wherein at least two connecting yarns have different second weave section widths.

6. The multi-layer woven fabric of claim 1, wherein within the central region, the first warp yarns and first weft yarns within the first woven layer are in a plain weave construction, and wherein within the central region, the second warp yarns and second weft yarns within the second woven layer are in a plain weave construction.

7. The multi-layer woven fabric of claim 1, wherein in the first weave section, the connecting yarn contains a plurality of stitches and floats with the first warp yarns, and wherein in the second weave section, the connecting yarn contains a plurality of stitches and floats with the second warp yarns.

8. The multi-layer woven fabric of claim 1, wherein first layer and second layer are interwoven in at least a portion of the outer region.

9. The multi-layer woven fabric of claim 1, wherein multi-layer woven fabric comprises two outer regions running parallel to the starting edge area of the central region and the ending edge area of the central region.

10. The multi-layer woven fabric of claim 1, wherein the first side and second side of the multi-layer woven fabric are treated with an air impermeable treatment.

11. An air impermeable multi-layer woven fabric comprising multi-layer woven fabric having a first side and a second side and having a warp and weft direction, wherein the weft direction is perpendicular to the warp direction, and wherein the multi-layer woven fabric contains a central region and at least one outer region, wherein the central region has a starting edge area and an ending edge area in the weft direction of the multi-layer woven fabric, wherein the central region comprises:

a first woven layer having an upper and lower surfaces and comprising a plurality of first warp yarns and first weft yarns, wherein the upper surface of the first woven layer forms the first side of the multi-layer woven fabric;

a second woven layer having an upper and lower surfaces and comprising a plurality of second warp yarns and second weft yarns, wherein the lower surface of the second woven layer forms the second side of the multi-layer woven fabric; and, a plurality of connecting yarns, wherein the connecting yarns connect the first woven layer and the second woven layer, wherein each connecting yarn has a stitching pattern that consists of a first weave section, a crossover section, and a second weave section; and, an air impermeable layer located on the first side and the second side of the multi-layer woven fabric;

wherein within the first weave section each connecting yarn is interwoven only with the first warp yarns of the first woven layer and the first weave section begins at the starting edge area of the central region and ends at a final weave stitch with the first warp yarns of the first woven layer;

wherein within the crossover section each connecting yarn is not interwoven with any yarns of the multi-layer woven fabric, wherein the crossover section begins at the final weave stitch with the first warp yarns of the first woven layer and ends with a first weave stitch with the second warp yarns of the second woven layer, wherein the length of connecting yarn between the final weave stitch with the first warp yarns and the first weave stitch with the second warp yarns of the second woven layer is defined as the crossover distance;

wherein within the second weave section each connecting yarn is interwoven only with the second warp yarns of the second woven layer and the second weave section begins at the first weave stitch with the second warp yarns of the second woven layer and ends at the ending edge area of the central region; and wherein within the starting edge area of the central region all of the connecting yarns are not interwoven with the second woven layer and at least a portion of the connecting yarns are interwoven with the first woven layer, and wherein within the ending edge area of the central region all of the connecting yarns are not interwoven with the first woven layer and at least a portion of the connecting yarns are interwoven with the second woven layer.

12. The air impermeable multi-layer woven fabric of claim 11, wherein the air impermeable layer comprises thermoplastic urethane.

13. The air impermeable multi-layer woven fabric of claim 11, wherein the air impermeable layer has a thickness of between about 25 and 100 microns.

14. The air impermeable multi-layer woven fabric of claim 11, wherein the crossover distance is between about 2 and 8 inches.

15. The air impermeable multi-layer woven fabric of claim 11, wherein the distance between the starting edge area of the central region and the final weave stitch with the first warp yarns of the first woven layer is defined as the first weave section width and wherein at least six connecting yarns have different first weave section widths, and wherein the distance between the first weave stitch with the second warp yarns of the second woven layer the ending edge area of the central region is defined as the second weave section width and wherein at least six connecting yarns have different second weave section widths.

16. The air impermeable multi-layer woven fabric of claim 11, wherein within the central region, the first warp yarns and first weft yarns within the first woven layer are in a plain weave construction, and wherein within the central region, the second warp yarns and second weft yarns within the second woven layer are in a plain weave construction.

17. The air impermeable multi-layer woven fabric of claim 11, wherein in the first weave section, the connecting yarn contains a plurality of stitches and floats with the first warp yarns, and wherein in the second weave section, the connecting yarn contains a plurality of stitches and floats with the second warp yarns.

18. The air impermeable multi-layer woven fabric of claim 11, wherein in the at least one outer region, the first woven layer and the second woven layer are attached.

19. The air impermeable multi-layer woven fabric of claim 11, wherein multi-layer woven fabric comprises two outer regions running parallel to the starting edge area of the central region and the ending edge area of the central region.

20. An inflatable support article comprising:

air impermeable multi-layer woven fabric comprising multi-layer woven fabric having a first side and a second side and having a warp and weft direction, wherein the weft direction is perpendicular to the warp direction, and wherein the multi-layer woven fabric contains a central region and at least one outer region, wherein the central region has a starting edge area and an ending edge area in the weft direction of the multi-layer woven fabric, wherein the central region comprises:

a first woven layer having an upper and lower surfaces and comprising a plurality of first warp yarns and first weft yarns, wherein the upper surface of the first woven layer forms the first side of the multi-layer woven fabric;

a second woven layer having an upper and lower surfaces and comprising a plurality of second warp yarns and second weft yarns, wherein the lower surface of the second woven layer forms the second side of the multi-layer woven fabric; and, a plurality of connecting yarns, wherein the connecting yarns connect the first woven layer and the second woven layer, wherein each connecting yarn has a stitching pattern that consists of a first weave section, a crossover section, and a second weave section; and, an air impermeable layer located on the first side and the second side of the multi-layer woven fabric;

wherein within the first weave section each connecting yarn is interwoven only with the first warp yarns of the first woven layer and the first weave section begins at the starting edge area of the central region and ends at a final weave stitch with the first warp yarns of the first woven layer;

wherein within the crossover section each connecting yarn is not interwoven with any yarns of the multi-layer woven fabric, wherein the crossover section begins at the final weave stitch with the first warp yarns of the first woven layer and ends with a first weave stitch with the second warp yarns of the second woven layer, wherein the length of connecting yarn between the final weave stitch with the first warp yarns and the first weave stitch with the second warp yarns of the second woven layer is defined as the crossover distance;

wherein within the second weave section each connecting yarn is interwoven only with the second warp yarns of the second woven layer and the second weave section begins at the first weave stitch with the second warp yarns of the second woven layer and ends at the ending edge area of the central region; and wherein within the starting edge area of the central region all of the connecting yarns are not interwoven with the second woven layer and at least a portion of the connecting yarns are interwoven with the first woven layer, and wherein within the ending edge area of the central region all of the connecting yarns are not interwoven with the first woven layer and at least a portion of the connecting yarns are interwoven with the second woven layer, wherein the air impermeable multi-layer woven fabric is configured to form a three-dimensional enclosed space having an outer surface and an inner surface; and, a port through the air impermeable multi-layer woven fabric.

21. The inflatable support article of claim 20, further comprising an air source capable of introducing gas into the three-dimensional enclosed space through the port.

22. The inflatable support article of claim 20, wherein the inflatable support article holds an air pressure of at least three fourths (75%) of an initial inflating pressure chosen between in a range of between 16.9 and 20.7 kPa (1.0 and 3.0 PSI) for at least 24 hours.

23. The inflatable support article of claim 20, wherein the air impermeable layer comprises thermoplastic urethane.

24. The inflatable support article of claim 20, wherein the distance between the starting edge area of the central region and the final weave stitch with the first warp yarns of the first woven layer is defined as the first weave section width and wherein at least six connecting yarns have different first weave section widths, and wherein the distance between the first weave stitch with the second warp yarns of the second woven layer the ending edge area of the central region is defined as the second weave section width and wherein at least six connecting yarns have different second weave section widths.

25. The inflatable support article of claim 20, wherein within the central region, the first warp yarns and first weft yarns within the first woven layer are in a plain weave construction, and wherein within the central region, the second warp yarns and second weft yarns within the second woven layer are in a plain weave construction.

26. The inflatable support article of claim 20, wherein in the first weave section, the connecting yarn contains a plurality of stitches and floats with the first warp yarns, and wherein in the second weave section, the connecting yarn contains a plurality of stitches and floats with the second warp yarns.

27. The inflatable support article of claim 20, wherein first layer and second layer are interwoven in at least a portion of the outer region.

* * * * *